US009397403B2

(12) United States Patent
Han et al.

(10) Patent No.: US 9,397,403 B2
(45) Date of Patent: Jul. 19, 2016

(54) DIPOLE ANTENNA

(75) Inventors: Myeong Woo Han, Gyunggi-do (KR); Jung Aun Lee, Gyunggi-do (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 482 days.

(21) Appl. No.: 13/333,398

(22) Filed: Dec. 21, 2011

(65) Prior Publication Data

US 2013/0082891 A1 Apr. 4, 2013

(30) Foreign Application Priority Data

Sep. 29, 2011 (KR) ..... 10-2011-0098962

(51) Int. Cl.

| | |
|---|---|
| ***H01Q 21/00*** | (2006.01) |
| ***H01Q 9/16*** | (2006.01) |
| ***H01Q 9/06*** | (2006.01) |
| ***H01Q 9/28*** | (2006.01) |

(52) U.S. Cl.

CPC ..... *H01Q 9/16* (2013.01); *H01Q 9/065* (2013.01); *H01Q 9/28* (2013.01)

(58) Field of Classification Search

CPC ..... H01Q 9/16; H01Q 1/38; H01Q 9/28
USPC ..... 343/727, 793, 824
See application file for complete search history.

(56) References Cited

U.S. PATENT DOCUMENTS

| | | | | |
|---|---|---|---|---|
| 5,534,877 | A * | 7/1996 | Sorbello | H01Q 21/061 343/700 MS |
| 7,050,014 | B1 * | 5/2006 | Chen et al. | 343/795 |
| 7,330,158 | B2 * | 2/2008 | Harihara | G06K 19/07786 343/700 MS |
| 7,508,346 | B2 | 3/2009 | Rao et al. | |
| 7,675,465 | B2 | 3/2010 | Doan et al. | |
| 2003/0197656 | A1 * | 10/2003 | Yang | H01Q 9/285 343/795 |
| 2005/0146480 | A1 * | 7/2005 | Yazdandoost | H01Q 9/285 343/795 |
| 2005/0253768 | A1 * | 11/2005 | Bui Hung | 343/790 |
| 2006/0092076 | A1 * | 5/2006 | Franson | H01Q 1/3233 343/700 MS |
| 2008/0079646 | A1 * | 4/2008 | Stuart | H01Q 9/285 343/795 |
| 2008/0180342 | A1 * | 7/2008 | Kerselaers | H01Q 9/285 343/795 |
| 2009/0079637 | A1 * | 3/2009 | Fukui | H01Q 1/241 343/700 MS |

FOREIGN PATENT DOCUMENTS

| | | |
|---|---|---|
| JP | 2005-086536 A | 3/2005 |
| JP | 2005-191705 | 7/2005 |
| KR | 10-2008-0111362 | 12/2008 |

OTHER PUBLICATIONS

Antenna Theory Analysis and Design, p. 70, section 2.11.*
AntennaFrequencyScalingTheARRLAntennaBook1988pp. 2-24to2-25.*
Korean Office Action, and English translation thereof, issued in Korena Patent Application No. 10-2011-0098962 dated Nov. 27, 2012.

* cited by examiner

*Primary Examiner* — Dameon E Levi
*Assistant Examiner* — Collin Dawkins
(74) *Attorney, Agent, or Firm* — NSIP Law

(57) ABSTRACT

There is provided a dipole antenna. The dipole antenna according to embodiments of the present invention includes: a substrate having a predetermined dielectric constant; and an antenna unit including at least one pair of electrodes and feed lines disposed on one surface of the substrate, wherein the electrodes receive current through the feed lines to generate a signal radiated in a direction in parallel with the one surface of the substrate.

18 Claims, 5 Drawing Sheets

DIPOLE ANTENNA

CROSS-REFERENCE TO RELATED APPLICATIONS

This application claims the priority of Korean Patent Application No. 10-2011-0098962 filed on Sep. 29, 2011, in the Korean Intellectual Property Office, the disclosure of which is incorporated herein by reference.

BACKGROUND OF THE INVENTION

1. Field of the Invention

The present invention relates to a dipole antenna including a substrate, and at least two electrodes and feed lines disposed on one surface of the substrate and generating a signal, radiated in a direction parallel to the one surface of the substrate, from a current supplied by the feed lines and flowing through the electrodes.

2. Description of the Related Art

A wireless communications system has been prominent as a necessary core technology in a modern society, and is included in many electronic devices to provide communications to users according to various standardizations. In particular, with the recent development of wireless communications technologies, capable of transmitting and receiving data at rapid speeds, in addition to the wireless communications of voice data, the use ratio of a wireless communications technology has been gradually expanded, based on portable devices such as mobile phones, tablet PCs, notebook computers, and the like.

In portable devices, such as mobile phones, tablet PC, or the like, a wireless communications system may necessarily need to be included, and may be handled as the most fundamental technology. However, cases in which wireless communications systems have been included in products such as home appliances, or the like, in addition to portable devices, have recently increased. In particular, in consideration of product slimness, in the case of an antenna applied to recent portable devices and home appliances, a patch antenna having a flat type structure has mainly been used.

However, when such a patch antenna is applied to portable devices, due to the characteristics thereof (front radiation) in which a signal is radiated to a front of a device, vertically with regard to a radiation electrode, portable devices need to be stood upright when wireless communications are intended to be performed therewith. Otherwise, communications sensitivity may be degraded. In addition, when a patch antenna having a multilayer structure is applied to ultra-thin products such as portable devices, a flat display device, or the like, the patch antenna may have an excessively large thickness within a limited form factor. Therefore, it may be difficult to apply a patch antenna to ultra-thin products.

SUMMARY OF THE INVENTION

An aspect of the present invention provides a dipole antenna having significantly increasing applicability to portable devices, slim-type home appliances, or the like, due to a structure thereof having a reduced thickness while allowing for a sideward radiation.

According to an aspect of the present invention, there is provided a dipole antenna, including: a substrate having a predetermined dielectric constant; and an antenna unit including at least one pair of electrodes and feed lines disposed on one surface of the substrate, wherein the electrodes receive current through the feed lines to generate a signal radiated in a direction in parallel with the one surface of the substrate.

The electrodes may receive a half-wavelength sinusoidal current flowing in a direction in parallel with the one surface of the substrate through the feed lines.

The electrodes may generate a signal radiated in a signal direction in parallel with the one surface of the substrate.

Characteristics of the radiated signal may be determined by at least one of a width of the electrodes, an interval between the electrodes, and a dielectric constant of the substrate.

A bandwidth of the radiated signal may be proportional to a multiplication of the width of the electrodes and the interval between the electrodes.

A return loss of the radiated signal may be inversely proportional to at least one of the width of the electrodes and the interval between the electrodes.

A resonant frequency of the radiated signal may be proportional to the width of the electrodes and be inversely proportional to the interval between the electrodes.

The electrodes may include a first electrode and a second electrode, and the feed lines may include a first feed line and a second feed line supplying current flowing in different directions, the first electrode being connected to the first feed line and the second electrode being connected to the second feed line.

The first electrode and the second electrode may have the same area and be disposed on the one surface of the substrate in such a manner as to be symmetrical with respect to each other, based on a predetermined axis in parallel with the one surface of the substrate.

According to another aspect of the present invention, there is provided a dipole antenna, including: a substrate having a predetermined dielectric constant; and an antenna unit including at least one pair of electrodes and feed lines disposed on one surface of the substrate, and receiving a half-wavelength sinusoidal current flowing in a direction in parallel with the one surface of the substrate through the feed lines, wherein the antenna unit generates a signal radiated in a direction in parallel with the one surface of the substrate from the half-wavelength sinusoidal current, and characteristics of the radiated signal are determined by at least one of a width of the electrodes, an interval between the electrodes, and a dielectric constant of the substrate.

Currents flowing through the at least one pair of electrodes may have the same direction, while the current flowing through the at least one pair of feed lines may have different directions.

A bandwidth of the radiated signal may be proportional to a multiplication of the width of the electrodes and the interval between the electrodes.

A return loss of the radiated signal may be inversely proportional to at least one of the width of the electrodes and the interval between the electrodes.

A resonant frequency of the radiated signal may be proportional to the width of the electrodes and be inversely proportional to the interval between the electrodes.

The at least one pair of electrodes may include a first electrode and a second electrode and the at least one pair of feed lines may include a first feed line and a second feed line supplying current flowing in different directions, the first electrode being connected to the first feed line and the second electrode being connected to the second feed line.

The first electrode and the second electrode may have the same area and are disposed on the one surface of the substrate in such a manner as to be symmetrical with respect to each other, based on a predetermined axis in parallel with the one surface of the substrate.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
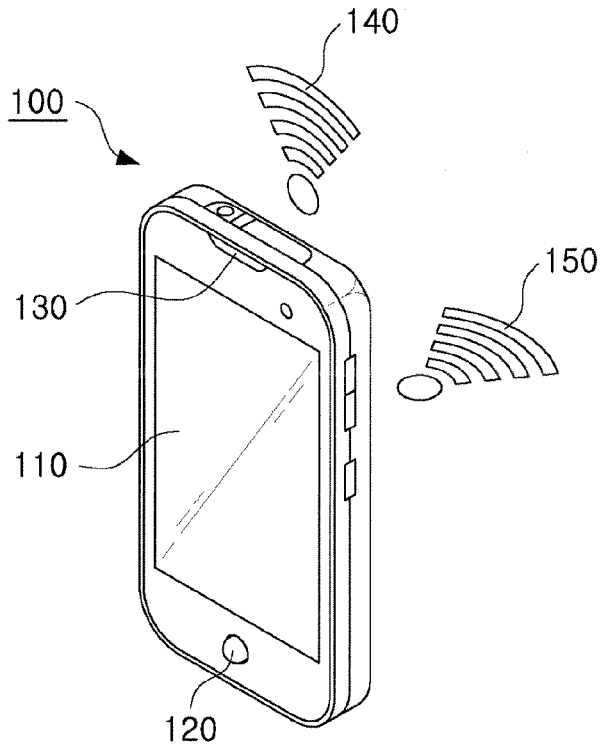
FIG. 1 is a perspective view showing an example of a portable device including a dipole antenna according to an embodiment of the present invention.

Embodiments of the present invention will be described in detail with reference to the accompanying drawings. These embodiments will be described in detail for those skilled in the art in order to practice the present invention. It should be appreciated that various embodiments of the present invention are different but do not have to be exclusive. For example, specific shapes, configurations, and characteristics described in an embodiment of the present invention may be implemented in another embodiment without departing from the spirit and the scope of the present invention. In addition, it should be understood that position and arrangement of individual components in each disclosed embodiment may be changed without departing from the spirit and the scope of the present invention. Therefore, a detailed description described below should not be construed as being restrictive. In addition, the scope of the present invention is defined only by the accompanying claims and their equivalents if appropriate. Similar reference numerals will be used to describe the same or similar functions throughout the accompanying drawing.

Hereinafter, embodiments of the present invention will be described in detail with reference to the accompanying drawings so that those skilled in the art may easily practice the present invention.

FIG. 1 is a perspective view showing an example of a portable device including a dipole antenna according to an embodiment of the present invention.

Although FIG. 1 shows that a portable device 100 according to the embodiment of the present invention is a mobile phone, the present invention is not limited thereto. Therefore, the portable device 100 needs to be construed as including a tablet PC, a notebook computer, a portable multimedia player (PMP), or the like, which has a wireless communication function. In addition, a small communications module providing a wireless communication function by connecting a universal serial bus (USB), or the like, to home appliances may also be considered as an example of the portable device 100 according to the embodiment of the present invention.

As shown in FIG. 1, the portable device 100 according to the embodiment of the present invention may include a display unit 110 for displaying a screen, an input unit 120, an audio output unit 130, and the like. Further, although not shown in the exterior perspective view of FIG. 1, the portable device 100 may include an antenna for wireless communications therein. In particular, the portable device 100 may include a dipole antenna optimized for lateral radiation according to the embodiment of the present invention, such that the portable device 100 may support lateral radiation 140 performed in a lateral direction thereof, rather than forward radiation or rear radiation 150 of the portable device 100.

In general, considering the use environment of the portable device 100, the portable device 100 may be used while being held by user's hand, or the portable device 100 may be used while being placed on a table such that the display unit 110 thereof faces the user. Therefore, when the wireless communications signal is radiated towards a rear surface of the portable device 100, the wireless communications signal is shielded by the user's hand, the table, or the like, to cause degradation in communication efficiency. In particular, in the case of 108.11.ad tri-band (2.4/5/60 GHz) that is currently being standardized, it may cause inconvenience in that the portable device 100 performs communications in the state of being necessarily stood, in the 60 GHz or another extremely high frequency (mmWave) band.

The dipole antenna according to the embodiment of the present invention may be mounted on the portable device 100 and support the lateral radiation 140, rather than the forward or rear radiation. Therefore, communication efficiency may be increased by providing radiation characteristics optimized for the use environment of the portable device 100. Hereinafter, a configuration of the dipole antenna according to the embodiment of the present invention will be described with reference to FIG. 2.

Figure 2:
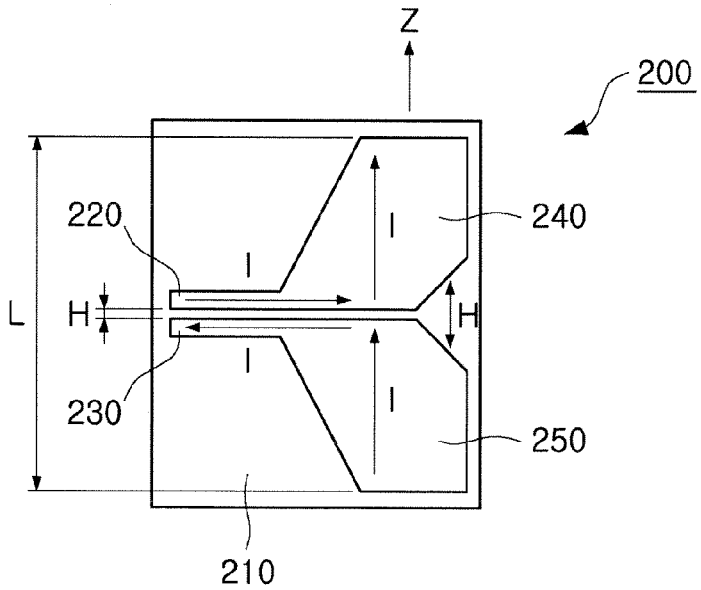
FIG. 2 is a plan view showing the dipole antenna according to the embodiment of the present invention.

FIG. 2 is a plan view showing the dipole antenna according to the embodiment of the present invention.

Referring to FIG. 2, a dipole antenna 200 according to the embodiment of the present invention may include a substrate 210 and an antenna unit including at least two feed lines 220 and 230 and electrodes 240 and 250, that are disposed on one surface of the substrate 210. Hereinafter, for the convenience of explanation, although the dipole antenna 200 in which the feed lines 220 and 230 and the electrodes 240 and 250 are disposed on a top surface of the substrate 210 having a hexahedral shape is described, the antenna unit including the feed lines 220 and 230 and the electrodes 240 and 250 may also be disposed on a bottom surface of the substrate 210 or disposed in the substrate 210 having a multilayer structure as an in-mold type. In the case of the in-mold type, the overall dipole antenna 200 may be configured in such a manner that the feed lines 220 and 230 and the electrodes 240 and 250 are manufactured in the form of a metal thin film having a very small thickness and thus, are inserted into the substrate 210 having the hexahedral shape, rather than being disposed on an outer side thereof.

The substrate 210 may be made of a dielectric material having a predetermined dielectric constant (∈), and the dielectric material may include FR4, low temperature co-fired ceramics (LTCC), organic-based Teflon or BT, Rogers, or the like. In consideration of price aspects, the substrate 210 may be made of a FR4 material. However, in order to implement the most excellent characteristics in the millimeter wave band, the substrate 210 may be made of LTCC, Teflon, BT, Rogers, or the like.

The antenna unit disposed on one surface of the substrate 210 may include the at least two longitudinally extending feed lines 220 and 230 and the respective electrodes 240 and 250. Here, a predetermined amount of a current is supplied to the at least two electrodes 240 and 250 through the at least two feed lines 220 and 230. Referring to FIG. 2, the feed lines 220 and 230 have a rectangular shape and supply the current to the electrodes 240 and 250 as a terminal feed type. The electrodes 240 and 250 have a predetermined of polygonal shape, such that each feed line forms an obtuse angle with its respective electrode. However, embodiments of the present invention are not necessarily limited to the shape shown in FIG. 2. The current supplied by the respective feed lines 220 and 230 may flow therethrough in opposite directions, and may flow through the respective electrodes 240 and 250 in the same direction to generate a radiated-wireless signal. Meanwhile, a current distribution in a z-axis direction within the electrodes 240 and 250 may be determined by an overall transverse extent or length L of the electrodes 240 and 250 in the z-axis direction and an amplitude Im of the current supplied by the feed lines 220 and 230, as in the following Equation 1. In Equation 1, β is denoted by 2π/λ as a propagation value, where λ refers to a wavelength of propagation.

$$I(z) = I_m * \sin\left[\beta * \left(\frac{L}{2} - |z|\right)\right] \quad \text{[Equation 1]}$$

That is, the current distribution within the electrodes 240 and 250 of the dipole antenna 200 is represented by a half-wavelength sinusoidal wave. In Equation 1, |z| is an absolute value of a z-axis coordinate. The z-axis coordinate has a maximum value of ±L/2, based on a middle point of the substrate 210 in the z-axis direction and thus, |z| may have a value of L/2 or less. As can be seen from Equation 1, the distribution of current I(z) may be determined according to |z| and L. Hereinafter, referring to FIGS. 3A to 3C, the current distribution in the dipole antenna 200 according to the embodiment of the present invention will be described.

Figure 3A:
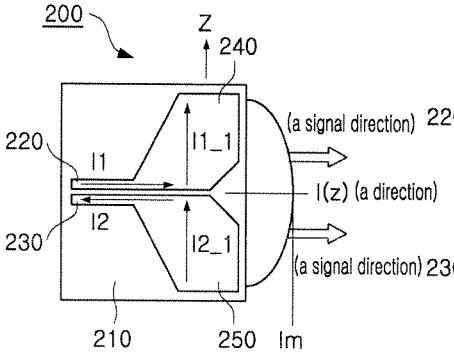
FIGS. 3A through 3C are diagrams showing a current distribution of the dipole antenna according to the embodiment of the present invention.
Figure 3B:
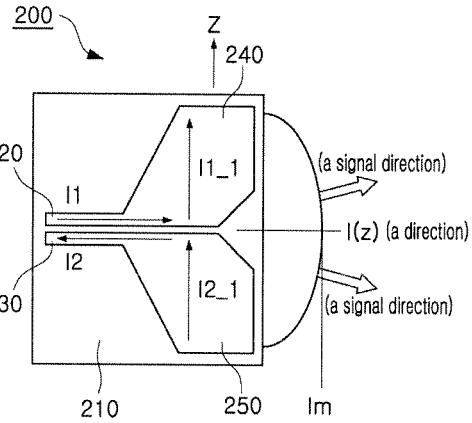
Figure 3C:
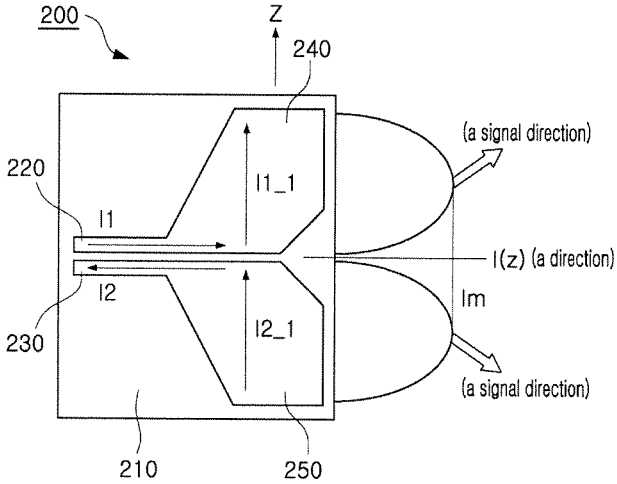

FIGS. 3A through 3C are diagrams showing a current distribution of the dipole antenna according to the embodiment of the present invention.

First, FIG. 3A is a diagram showing the current distribution of the dipole antenna 200 when the length L of the electrodes 240 and 250 is smaller than λ/2 (L<λ/2). Referring to FIG. 3A, a maximum value of the current I (z) is shown in the middle point of the substrate 210 in the z-axis direction, in which |z|=0. When the length L of the electrodes 240 and 250 is smaller than λ/2, since currents I1_1 and I2_1 flowing through the respective first electrode 240 and the second electrode 250 may not have opposite phases, the current I (z) in the middle point, in which |z|=0 has the maximum value.

FIG. 3B is a diagram showing the current distribution of the dipole antenna 200 when the length L of the electrodes 240 and 250 is equal to λ/2 (L<λ/2). Referring to FIG. 3B, similar to FIG. 3A, the maximum value of the current I (z) is shown in the middle point, in which |z|=0. When L is substituted with λ/2 in Equation 1, the maximum value of the current I(z) is shown in the middle point, in which |z|=0. This is due to the fact that, when L is equal to λ/2, the currents I1_1 and I2_1 flowing through the respective first electrode 240 and the second electrode 250 may not have opposite phases, similarly to FIG. 3A.

FIG. 3C is a diagram showing the current distribution of the dipole antenna 200 when the length L of the electrodes 240 and 250 is greater than λ/2 (L>λ/2). Referring to FIG. 3C, the current I (Z) has a minimum value in the middle point of the substrate in the z-axis direction, in which |z|=0, unlike the cases of FIGS. 3A and 3B. This is due to the fact that the currents I1_1 and I2_1 flowing through the first electrode 240 and the second electrode 250 may have opposite phases to cause an offset effect in a radiation pattern. In particular, when L has a value of n*=, the current I(z) becomes 0 in the middle point of the substrate 210 in the z-axis direction.

Figure 4:
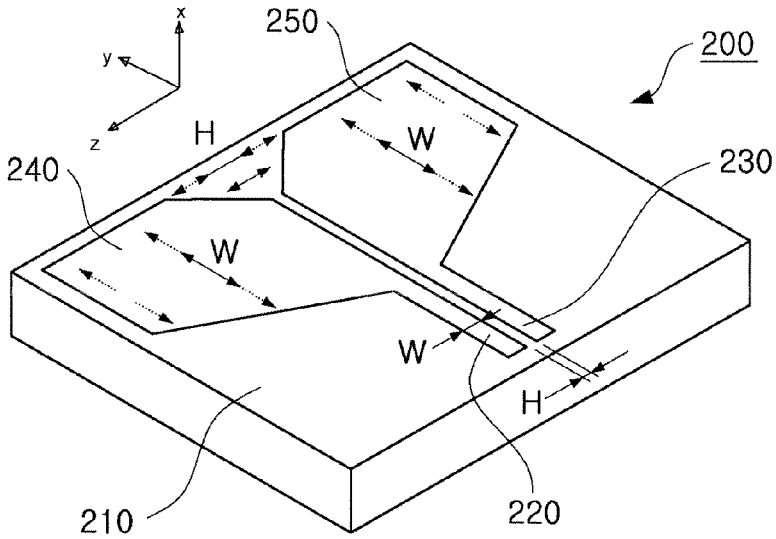
FIG. 4 is a perspective view showing the dipole antenna according to the embodiment of the present invention.

FIG. 4 is a perspective view showing the dipole antenna according to the embodiment of the present invention.

Referring to FIG. 4, the dipole antenna 200 according to the embodiment of the present invention may include the substrate 210 and the antenna unit including the at least two feed lines 220 and 230 and electrodes 240 and 250 disposed on one surface of the substrate 210, as described with reference to FIG. 2. Hereinafter, for the convenience of explanation, the electrode 240 and the feed line 220 which are disposed on the relatively left side in FIG. 4 are referred to as a first electrode (reference numeral 240) and a first feed line (reference numeral 220), respectively, while the electrode 250 and the feed line 230 which are disposed on the relatively right side in FIG. 4 are referred to as a second electrode (reference numeral 250) and a second feed line (reference numeral 230), respectively. Further, an interval between the first electrode 240 and the second electrode 250 is referred to as H and a width of the first electrode 240 and the second electrode 250 is referred to as W. In addition, it is assumed that each of the first electrode 240 and the first feed line 220 is symmetrical with and has the same shape and area as each of the second electrode 250 and the second feed line 230.

When the current is supplied by the first feed line 220 and the second feed line 230, the wireless signal radiated in a predetermined direction due to the current flowing through the first electrode 240 and the second electrode 250 may be generated. In this case, the wireless signal is radiated in a direction (y-axis direction) which is in parallel with one surface of the substrate 210 having the antenna unit formed thereon and a bandwidth of the radiated signal may be given as the following Equation 2.

$$BW = \frac{1}{\sqrt{2}} \frac{W}{\lambda} \frac{H}{\lambda} \frac{4\pi^2}{5\sqrt{\varepsilon}} \quad \text{[Equation 2]}$$

Equation 2 may be applied to a strip dipole antenna, that is, a dipole antenna in which an antenna unit formed of a thin metal plate is realized. In Equation 2, W is a width of the first electrode 240 and the second electrode 250 in the y-axis direction, H corresponds to the interval between the first electrode 240 and the second electrode 250, and ∈ is a dielectric constant of the substrate 210. That is, a bandwidth BW of the dipole antenna 200 may be increased in proportion to the multiplication of the width of the first and second electrodes 240 and 250 and the interval therebetween, to reach to 3.82 dB. However, the width W of the first and second electrodes 240 and 250 may not be set to randomly extend, in consideration of the limitation of a form factor and other characteristics (example, resonant frequency, impedance change), or the like. The bandwidth needs to be set according to a trade-off in consideration of other characteristics of the dipole antenna 200, the limitation of the form factor, or the like. The bandwidth according to a relationship between the wavelength λ of the signal, W and H is represented by a graph as FIG. 8.

Figure 8:
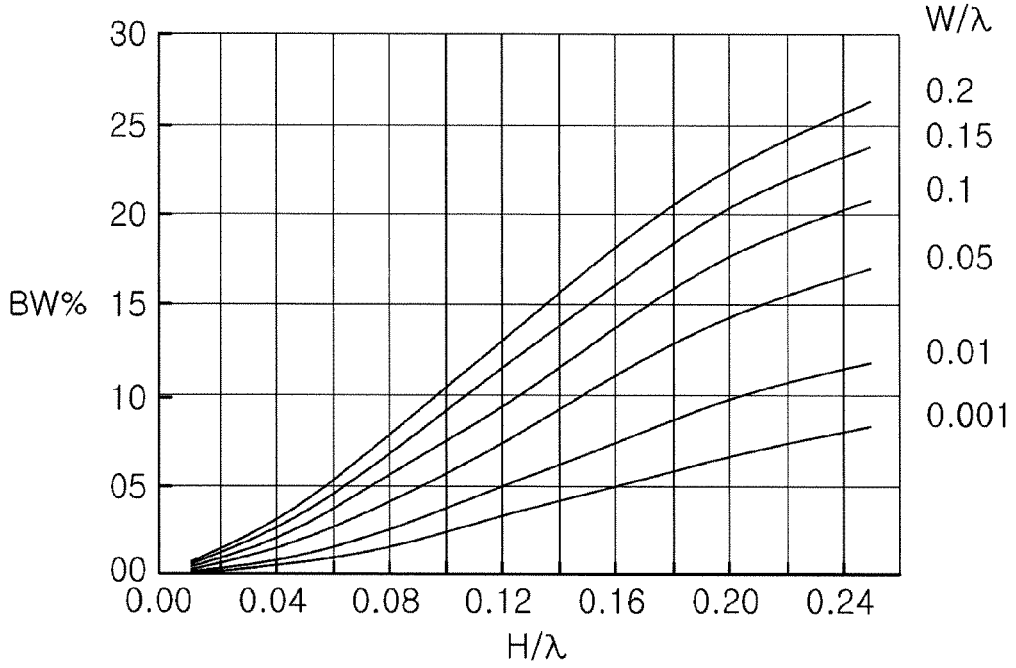
FIG. 8 is a graph showing a relationship between bandwidth (BW), wavelength (λ), electrode width (W) and electrode interval (H) of the dipole antenna according to the embodiment of the present invention.

As shown in FIG. 8, the ratios of the wavelength λ, H and W are appropriately controlled, such that the bandwidth of 10 to 20% may be easily obtained in a case in which H is 0.1λ to 0.2λ.

Meanwhile, as the width W of the first and second electrodes 240 and 250 is greater, the bandwidth is increased while the impedance change of the respective electrodes 240 and 250 may be significant. The radiation resistance of the dipole antenna implemented on a plane of the substrate 210 is associated with the impedance of the respective electrodes 240 and 250. In particular, the radiation resistance of the dipole antenna may be determined by the width W of the respective electrodes 240 and 250 and a height h of the substrate 210. Therefore, in order to increase the bandwidth, excessively increasing the width W of the respective electrodes 240 and 250 may not be preferable in consideration of impedance characteristics. As described above, a design formed by considering the trade-off is required. In particular, when a mismatch occurs in the impedance characteristics, this may lead to deterioration in the return loss characteristics of the dipole antenna 200. This is also similar to a resonant frequency determined by the width W of the electrodes 240 and 250 and the interval H between the electrodes 240 and 250, which will be described with reference to FIGS. 5 and 6.

Figure 5:
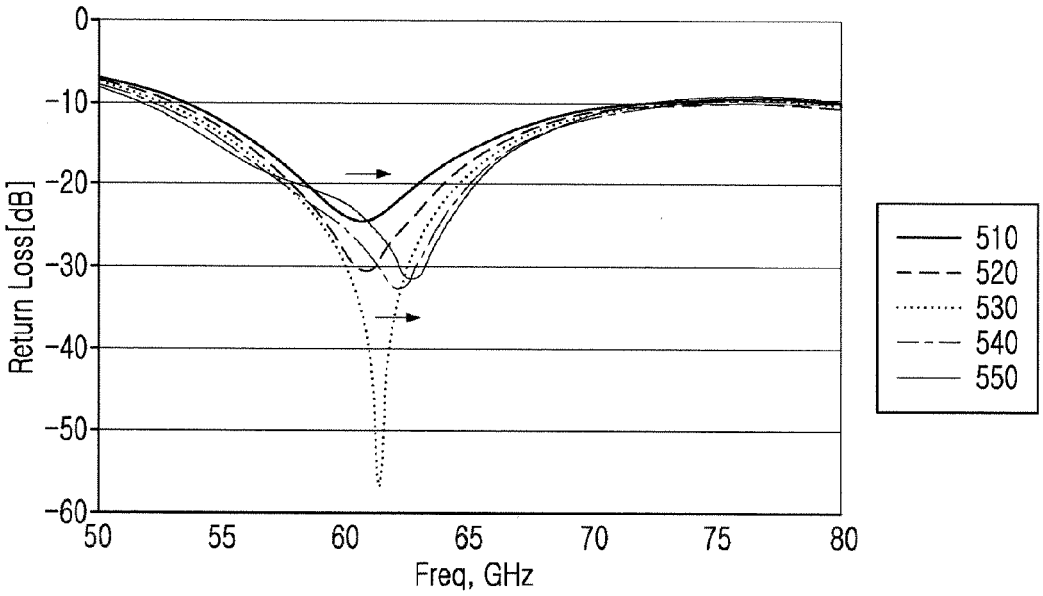
FIGS. 5 and 6 are graphs showing a relationship between a return loss and a frequency of the dipole antenna according to the embodiment of the present invention.
Figure 6:
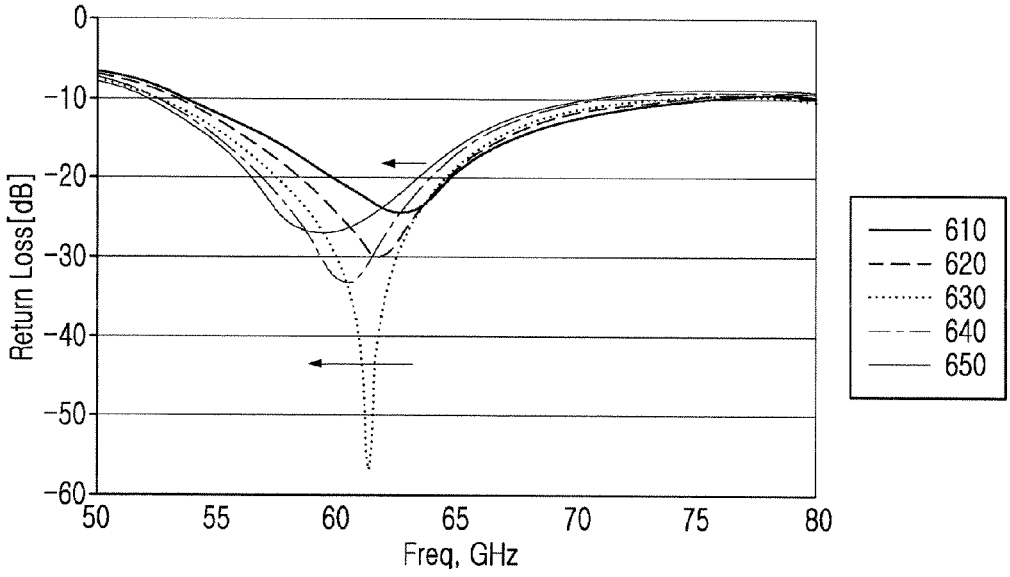

FIGS. 5 and 6 are graphs showing a relationship between a return loss and a frequency of the dipole antenna according to the embodiment of the present invention.

First, referring to FIG. 5, FIG. 5 shows the relationship between the return loss and the frequency according to a change in the width W of the electrodes 240 and 250 and a resonant frequency. Referring to FIG. 5, FIG. 5 shows a change in a return loss according to a frequency with respect to five conditions. Here, a frequency having the largest return loss, in the respective graphs 510 to 550, having individual conditions, corresponds to the resonant frequency. The third condition 530 denoted by a small dotted line in FIG. 5 corresponds to the case in which the return loss characteristics according to the width W of the electrodes 240 and 250 are optimized. In this case, the resonant frequency may be in approximately 62 GHz and the return loss has a value approximate to −60 dB. The fourth condition 540 and the fifth condition 550 are cases in which the width W of the electrodes 240 and 250 is increased by 50 μm and 100 μm, respectively, as compared with the case of the third condition 530, and the bandwidth is increased and the resonant frequency moves to a high frequency side, as compared with the case of the third condition 530, as illustrated in FIG. 5. However, as shown in FIG. 5, it can be appreciated that the return loss characteristics may be very deteriorated as compared with the case of the third condition 530.

Conversely, the first condition 510 and the second condition 520 are graphs corresponding to the case in which the width W of the electrodes 240 and 250 is reduced to 50 μm and 100 μm, respectively, as compared with the case of the third condition 530. To the contrary to the fourth and fifth conditions 540 and 550, it can be appreciated that the resonant frequency moves to a low frequency side and the bandwidth is reduced and the return loss characteristics are deteriorated, as compared with the case of the third condition 530.

FIG. 6 is a graph showing the relationship between the return loss and the frequency according to the change in the interval H between the electrodes 240 and 250. Similar to FIG. 5, a third condition 630 corresponds to an optimized case in FIG. 6. In the case of the third condition 630, the resonant frequency may be in 61 to 62 GHz and the return loss has a value of about −60 dB. In the case of the fourth and fifth conditions 640 and 650 having the value of interval H greater than that of the third condition 630, the resonant frequency moves to the low frequency side. Conversely, in the case of the first and second conditions 610 and 620 having the value of the interval H smaller than that of the third condition 630, the resonant frequency moves to the high frequency side. However, all of the first, second, fourth, and fifth conditions 610, 620, 640, and 650 show that the return loss characteristics thereof are deteriorated. That is, as can be appreciated from Equation 2, and FIGS. 5, 6 and 8, the radiation characteristics of the dipole antenna 200 according to the embodiment of the present invention are determined by parameters, such as the width W of the electrodes 240 and 250, the interval H between the electrodes 240 and 250, the dielectric constant of the substrate 210, the height of the substrate 210, or the like. The radiation characteristics may be controlled by increasing the ratio of W/H at the time of designing the dipole antenna 200 when the resonant frequency is increased to the high frequency side and conversely, reducing the ratio of the W/H when the resonant frequency is reduced to the low frequency side. However, when the values of the W and H are not designed to be optimized, return loss characteristics are deteriorated, such that it is difficult to implement the dipole antenna 200 having the desired performance as in the graphs shown in FIGS. 5 and 6. Therefore, approximately controlling the trade-off between the respective characteristics may be required. For example, as in the third condition 530 shown in FIG. 5, the desired bandwidth, the resonant frequency, or the like, may be set by providing the width W of the respective electrodes 240 and 250 as a value in which the return loss according to the frequency has the maximum value, and finely controlling the interval H between the electrodes 240 and 250, or the like.

Figure 7:
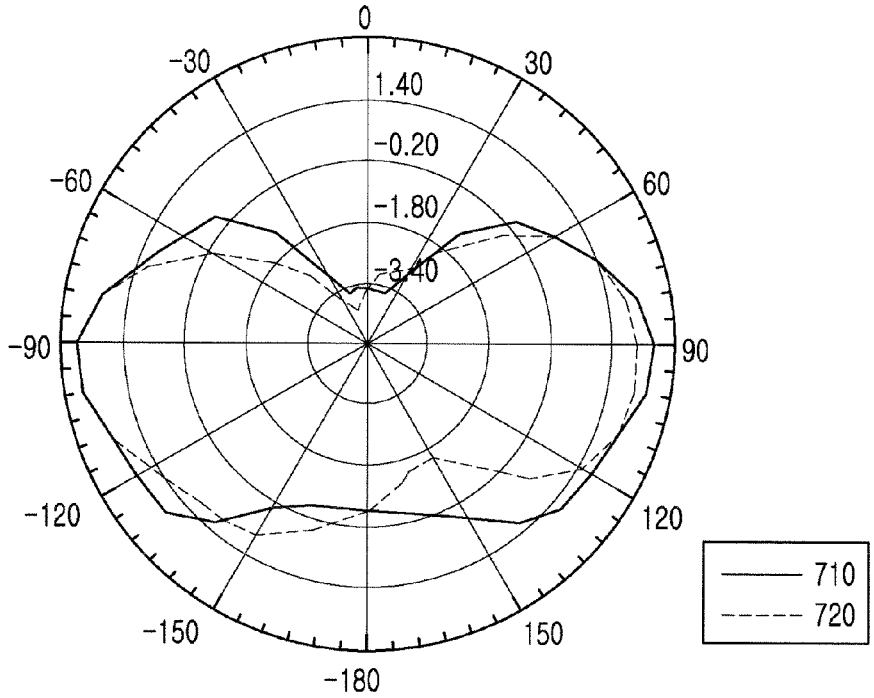
FIG. 7 is a graph showing a radiation pattern of the dipole antenna according to the embodiment of the present invention.

FIG. 7 is a graph showing a radiation pattern of a dipole antenna according to the embodiment of the present invention.

Referring to FIG. 7, radiation patterns of an E-plane 710 and an H-plane 720 are shown as simulation results of the dipole antenna 200 according to the embodiment of the present invention. The radiation patterns shown in FIG. 7 correspond to radiation patterns in the frequency band of approximately 60 GHz.

As set forth above, according to the embodiments of the present invention, there is provided the dipole antenna optimized for the communications characteristics and the lateral radiation of respective device requiring a wireless communication function, such as portable devices, home appliances, or the like, by disposing the antenna unit including at least two electrodes and feed lines on one surface of the substrate having a predetermined dielectric constant, and controlling the width of the electrodes and the interval therebetween, the dielectric constant of the substrate, or the like so as to obtain the desired radiation characteristics.

Hereinabove, although the present invention is described by specific matters such as concrete components, and the like, exemplary embodiments, and drawings, they are provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to the above-described exemplary embodiments, and the following claims as well as all modified equally or equivalently to the claims are intended to fall within the scope and spirit of the invention.

What is claimed is:

1. A dipole antenna, comprising:

a substrate having a predetermined dielectric constant; and an antenna unit including at least one pair of electrodes and respective longitudinally extending feed lines disposed on one surface of the substrate, wherein:

the electrodes receive current through the feed lines to generate a signal radiated in a direction in parallel with the one surface of the substrate, and the electrodes receive a half-wavelength sinusoidal current flowing in a direction in parallel with the one surface of the substrate through the feed lines, wherein the at least one pair of electrodes and respective feed lines are separated by an interval within the range of 0.2 to 0.4 of an overall transverse extent of the pair of electrodes.

2. The dipole antenna of claim 1, wherein characteristics of the radiated signal are determined by at least one of a width of the electrodes, the interval between the electrodes, and a dielectric constant of the substrate.

3. The dipole antenna of claim 2, wherein the bandwidth of the radiated signal is proportional to a multiplication of the width of the electrodes and the interval between the electrodes.

4. The dipole antenna of claim 2, wherein a return loss of the radiated signal is inversely proportional to at least one of the width of the electrodes and the interval between the electrodes.

5. The dipole antenna of claim 2, wherein a resonant frequency of the radiated signal is proportional to the width of the electrodes and is inversely proportional to the interval between the electrodes.

6. The dipole antenna of claim 1, wherein the electrodes include a first electrode and a second electrode, and the feed lines include a first feed line and a second feed line supplying current flowing in different directions, the first electrode being connected to the first feed line and the second electrode being connected to the second feed line.

7. The dipole antenna of claim 6, wherein the first electrode and the second electrode have the same area and are disposed on the one surface of the substrate in such a manner as to be symmetrical with respect to each other, based on a predetermined axis in parallel with the one surface of the substrate.

8. The dipole antenna of claim 1, wherein the at least one pair of electrodes include a first electrode and a second electrode and the at least one pair of feed lines include a first feed line and a second feed line, and each of the first electrode and the first feed line is symmetrical with and has the same shape and area as each of the second electrode and the second feed line.

9. The dipole antenna of claim 8, wherein each feed line forms an obtuse angle with its respective electrode.

10. A dipole antenna, comprising:

a substrate having a predetermined dielectric constant; and an antenna unit including at least one pair of electrodes and respective longitudinally extending feed lines disposed on one surface of the substrate, and receiving a half-wavelength sinusoidal current flowing in a direction in parallel with the one surface of the substrate through the feed lines, wherein the antenna unit generates a signal radiated in a direction in parallel with the one surface of the substrate from the half-wavelength sinusoidal current, and characteristics of the radiated signal are determined by at least one of a width of the electrodes, an interval between the electrodes, and a dielectric constant of the substrate, wherein the at least one pair of electrodes and respective feed lines are separated by an interval within the range of 0.2 to 0.4 of an overall transverse extent of the pair of electrodes.

11. The dipole antenna of claim 10, wherein current flowing through the at least one pair of electrodes has the same direction, while the current flowing through the at least one pair of feed lines has different directions.

12. The dipole antenna of claim 10, wherein the bandwidth of the radiated signal is proportional to a multiplication of the width of the electrodes and the interval between the electrodes.

13. The dipole antenna of claim 10, wherein a return loss of the radiated signal is inversely proportional to at least one of the width of the electrodes and the interval between the electrodes.

14. The dipole antenna of claim 10, wherein a resonant frequency of the radiated signal is proportional to the width of the electrodes and is inversely proportional to the interval between the electrodes.

15. The dipole antenna of claim 10, wherein the at least one pair of electrodes include a first electrode and a second electrode and the at least one pair of feed lines include a first feed line and a second feed line supplying current flowing in different directions, the first electrode being connected to the first feed line and the second electrode being connected to the second feed line.

16. The dipole antenna of claim 15, wherein the first electrode and the second electrode have the same area and are disposed on the one surface of the substrate in such a manner as to be symmetrical with respect to each other, based on a predetermined axis in parallel with the one surface of the substrate.

17. The dipole antenna of claim 10, wherein the at least one pair of electrodes include a first electrode and a second electrode and the at least one pair of feed lines include a first feed line and a second feed line, and each of the first electrode and the first feed line is symmetrical with and has the same shape and area as each of the second electrode and the second feed line.

18. The dipole antenna of claim 17, wherein each feed line forms an obtuse angle with its respective electrode.

* * * * *